US008333444B1

(12) United States Patent
Chang

(10) Patent No.: US 8,333,444 B1
(45) Date of Patent: Dec. 18, 2012

(54) FURNITURE KIT

(76) Inventor: Chien-Kuo Chang, Taichung (TW)

( * ) Notice: Subject to any disclaimer, the term of this patent is extended or adjusted under 35 U.S.C. 154(b) by 309 days.

(21) Appl. No.: 12/815,778

(22) Filed: Jun. 15, 2010

(51) Int. Cl.
*A47B 47/00* (2006.01)

(52) U.S. Cl. ..... 312/262; 312/258

(58) Field of Classification Search ..... 312/258, 312/262
See application file for complete search history.

(56) References Cited

U.S. PATENT DOCUMENTS 1,481,560 A * 1/1924 Ringer ..... 312/258
3,527,339 A * 9/1970 Cipolla ..... 206/290
3,527,340 A * 9/1970 Cipolla ..... 206/278
5,593,046 A * 1/1997 Katsuura et al. ..... 211/41.15
5,664,854 A * 9/1997 Letch ..... 312/262
6,848,758 B1 * 2/2005 Yeh et al. ..... 312/258
7,748,798 B2 * 7/2010 LeTourneau et al. ..... 312/258
8,015,931 B2 * 9/2011 Lin ..... 108/193
2005/0067927 A1 * 3/2005 Ho et al. ..... 312/258

* cited by examiner

*Primary Examiner* — Hanh V Tran
(74) *Attorney, Agent, or Firm* — Coats & Bennett, P.L.L.C.

(57) ABSTRACT

A furniture kit that is configured to be transformed into a furniture piece. The furniture kit includes a folding unit comprising a front member and a back member, both of which are interconnected by folding arms. The front and back members are movable between retracted and extended positions. There is also provided a pair of side panels with each side panel being connectable through a tongue and groove arrangement to the front and back members. A top is secured to the folding unit. The entire furniture kit can be packaged in a compact container with the folding unit in a collapsed or retracted position and other individual components of the kit placed adjacent thereto.

21 Claims, 14 Drawing Sheets

FURNITURE KIT

FIELD OF THE INVENTION

The present invention relates to furniture to a furniture kit that can be configured to be transformed into a wide variety of furniture pieces, and more particularly to a furniture kit having a foldable box-like unit that can assume a retracted or collapsed position, and which can be extended to an operative or extended position.

BACKGROUND OF THE INVENTION

Ready-to-assemble (RTA) furniture is marketed throughout the world. One can find a wide variety of RTA furniture, especially in the area of bookcases, desks, tables, etc. One of the reasons that RTA furniture has gained acceptance over the years is that by utilizing an RTA approach, manufacturers are able to lower manufacturing costs and shipping costs. There are, however, numerous drawbacks to RTA furniture. It is uncommon to find high end or high quality furniture designed and built as RTA furniture. Generally speaking, in RTA furniture one will find exposed fasteners such as screws, and even camlocks. Indeed, as a general rule, ready-to-assemble furniture has a look that is not always pleasing an in many instances immediately tells a consumer that this is RTA furniture. RTA furniture is not always pleasing.

In addition, RTA furniture is difficult and time consuming to assemble. In some cases it requires special tools. Furthermore, after being assembled, many RTA furniture pieces are not strong and sturdy.

Therefore, there is a need for an approach to manufacturing furniture where the furniture unit or piece can be packaged in a compact container and shipped at a relatively low cost, and at the same time there is a need for such a furniture approach where the furniture unit or kit is easy to assemble and does not have the conventional look of a ready-to-assemble furniture piece.

SUMMARY OF THE INVENTION

The present invention relates to a furniture kit that includes a group of components that can be packaged in a compact container and shipped.

In one particular embodiment, the furniture kit includes a folding unit that includes a front member and a back member interconnected by one or more movable connectors that permits the front and back members to assume a retracted or collapsed position and an extended position. In the extended position a pair of side panels are connected to the front and back members. A top is then secured to the folding unit.

In another embodiment of the present invention, the furniture kit is provided with a pair of side panels that include locking members. When the side panels are connected to the front and back members through a tongue and groove arrangement, the locking members associated with the side panels engage and interlock with the fold-out connectors or arms that are interconnected between the front and back members of the furniture kit.

Other objects and advantages of the present invention will become apparent and obvious from a study of the following description and the accompanying drawings which are merely illustrative of such invention.

BRIEF DESCRIPTION OF THE DRAWINGS

FIG. 7A is an end elevational view showing the side panel prior to being inserted into the folding unit.

FIG. 7B is a fragmentary side elevation view corresponding to FIG. 7A.

FIG. 7C is similar to FIG. 7A, but with the side panel being shown being inserted into the folding unit.

FIG. 7D is a fragmentary side elevation view corresponding to FIG. 7C.

FIG. 7E is an end elevational view similar to FIG. 7C, but wherein the side panel is further inserted into the folding unit.

FIG. 7F is a fragmentary side elevation view corresponding to FIG. 7E.

FIG. 7G is an end elevational view similar to FIG. 7E, but showing the side panel completely inserted into the folding unit.

FIG. 7H is a fragmentary side elevation view corresponding to FIG. 7G.

DETAILED DESCRIPTION

Figure 1:
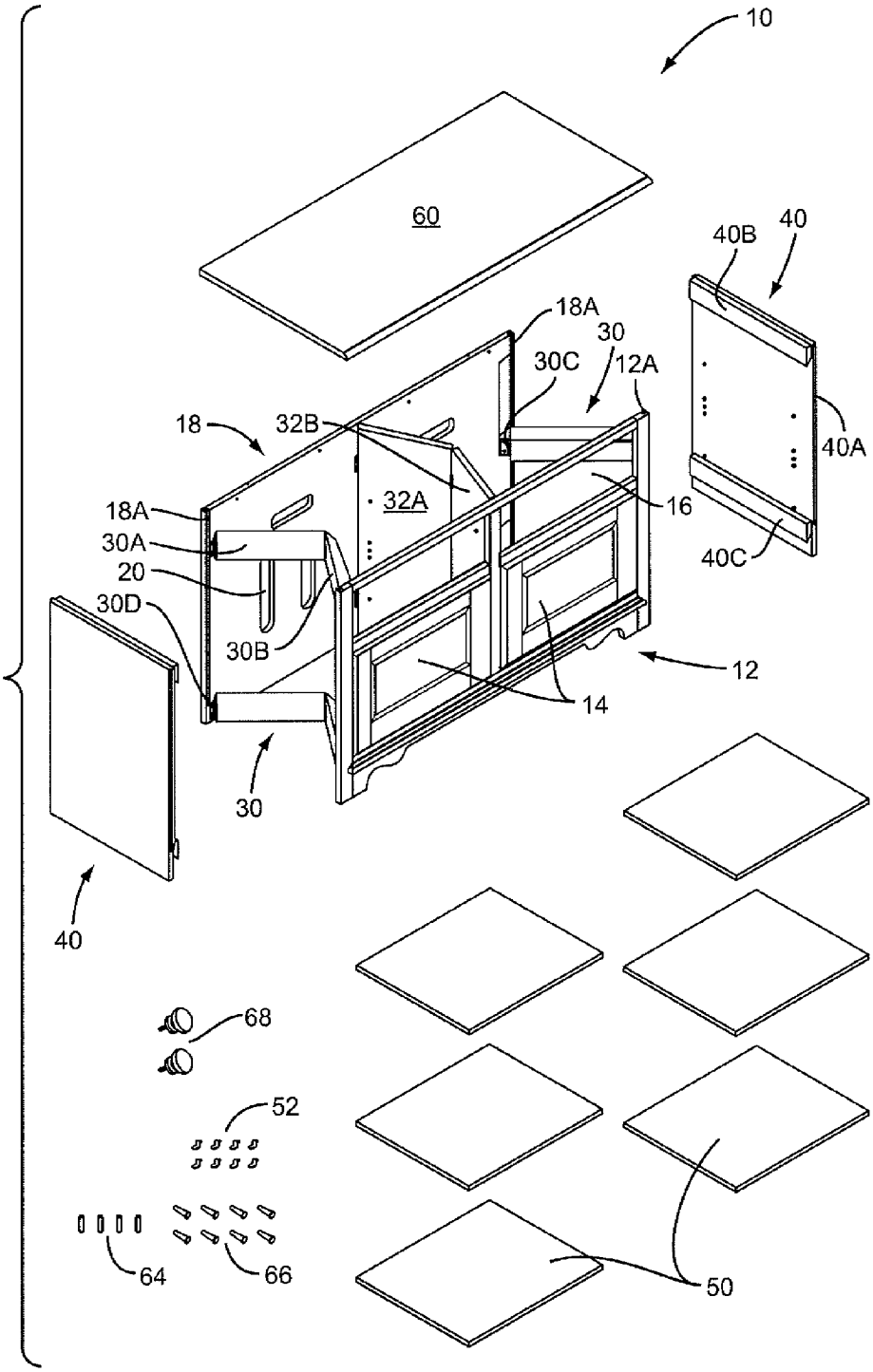
FIG. 1 is an exploded view of the furniture kit of the present invention.
Figure 11:
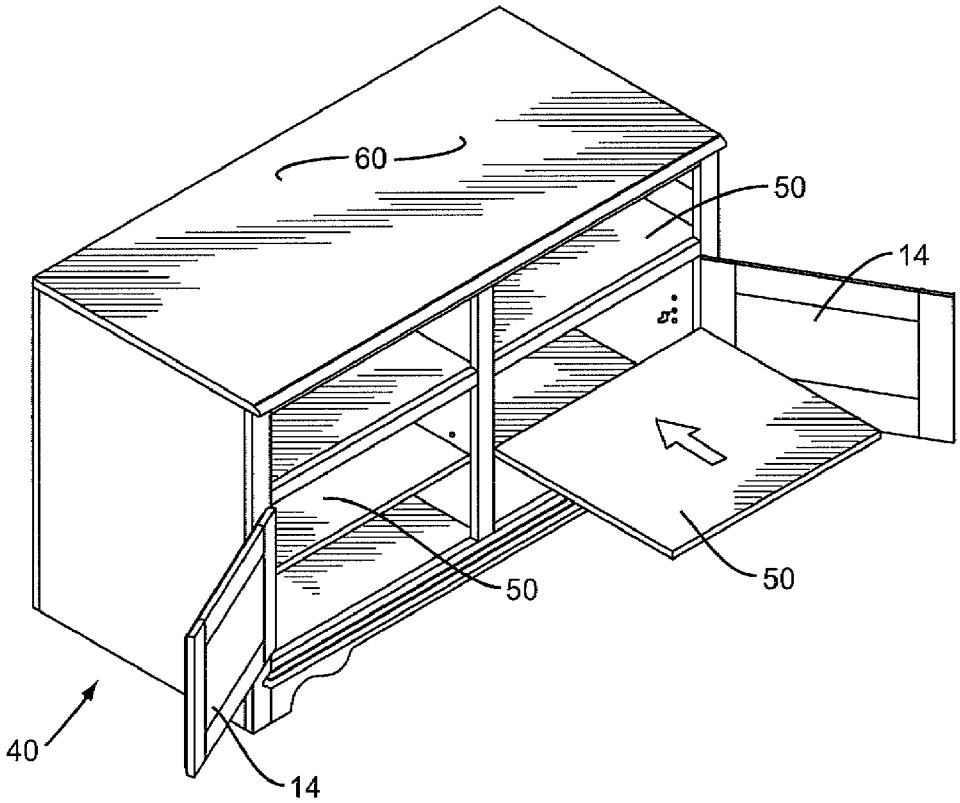
FIG. 11 is a perspective view showing an intermediate shelf being inserted into the folding unit.
Figure 12:
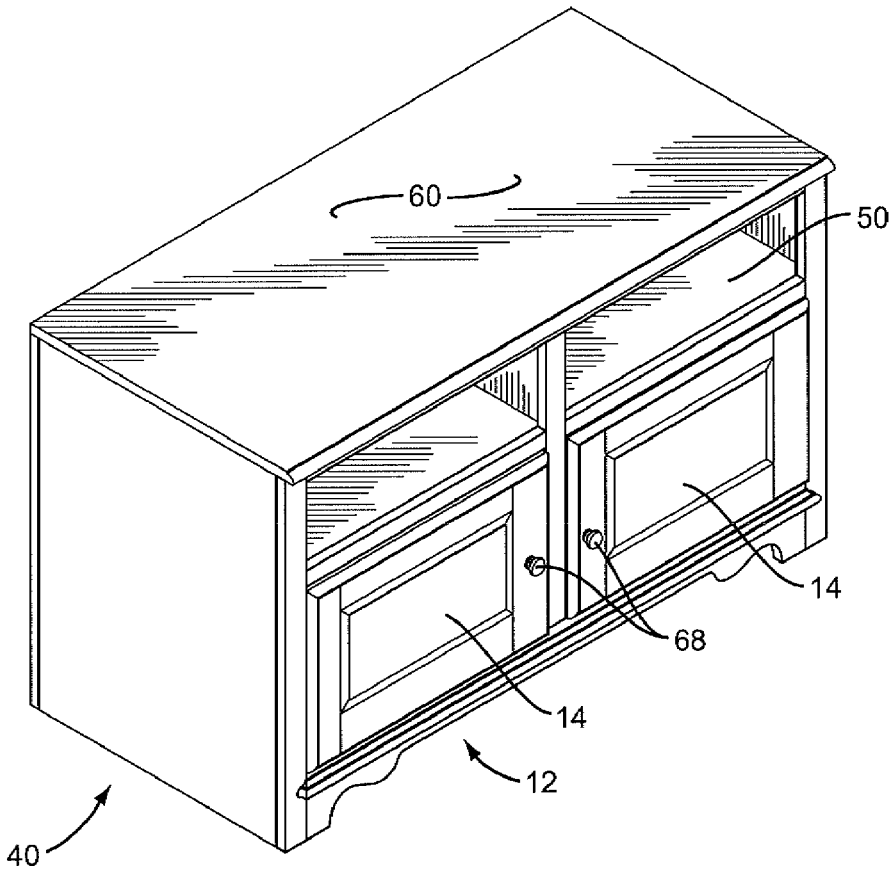
FIG. 12 is a perspective view showing the furniture piece that is formed from the furniture kit.

With further reference to the drawings, the furniture kit of the present invention is shown therein and indicated generally by the numeral 10. Various components of the furniture kit 10 are shown in FIG. 1. When these components are assembled according to the present invention, a furniture piece such as shown in FIG. 11 is formed. In the embodiment illustrated herein, the formed furniture piece is in the form of an entertainment unit or device. It will be understood, however, by those skilled in the art, that the furniture kit and method of forming a furniture piece can be applied to a wide variety of different furniture pieces, such as a chest of drawers, buffet, or any box-type furniture piece.

Figure 2:
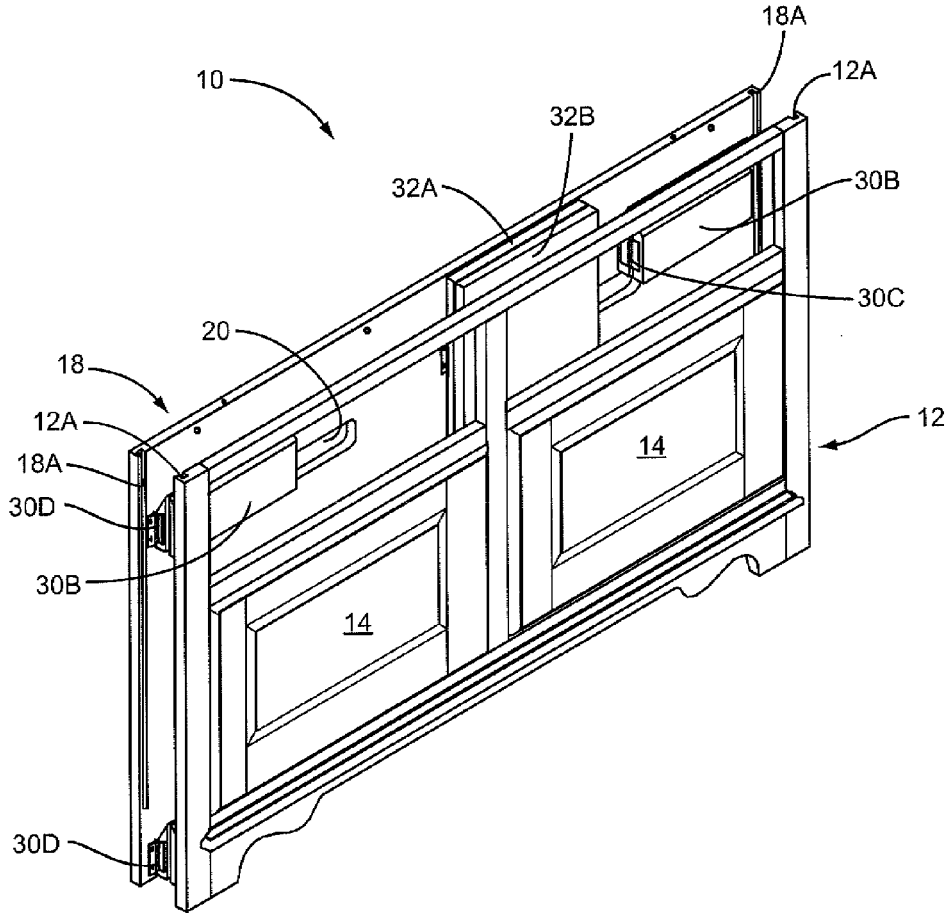
FIG. 2 is a perspective view showing the front and back members of the furniture kit in a retracted or collapsed position.
Figure 3:
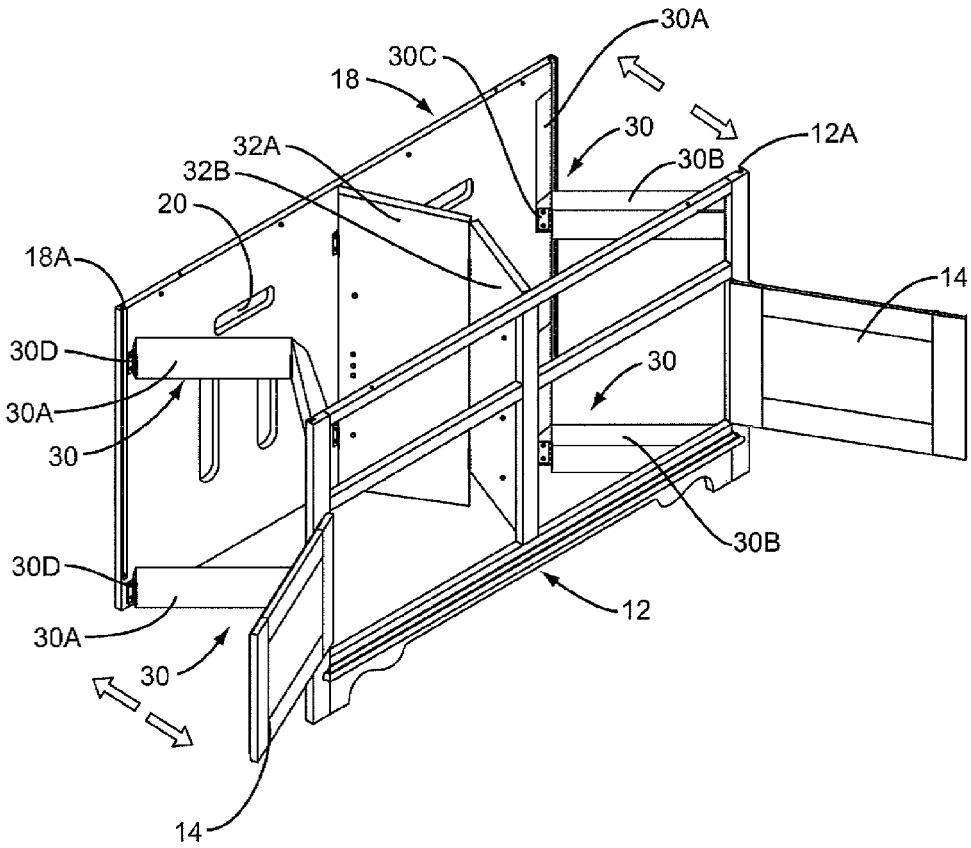
FIG. 3 is a perspective view showing the front and back members of the furniture kit in an intermediate position between the retracted position and the extended position.
Figure 4:
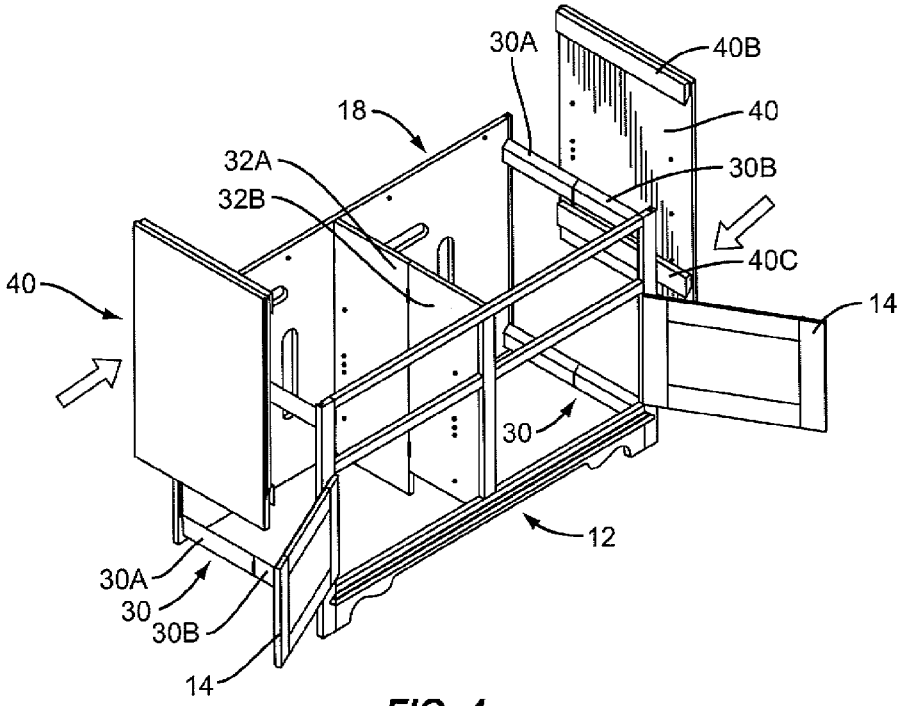
FIG. 4 is a perspective view of the furniture kit illustrating the insertion of side panels into the folding unit that forms a part of the kit.
Figure 5:
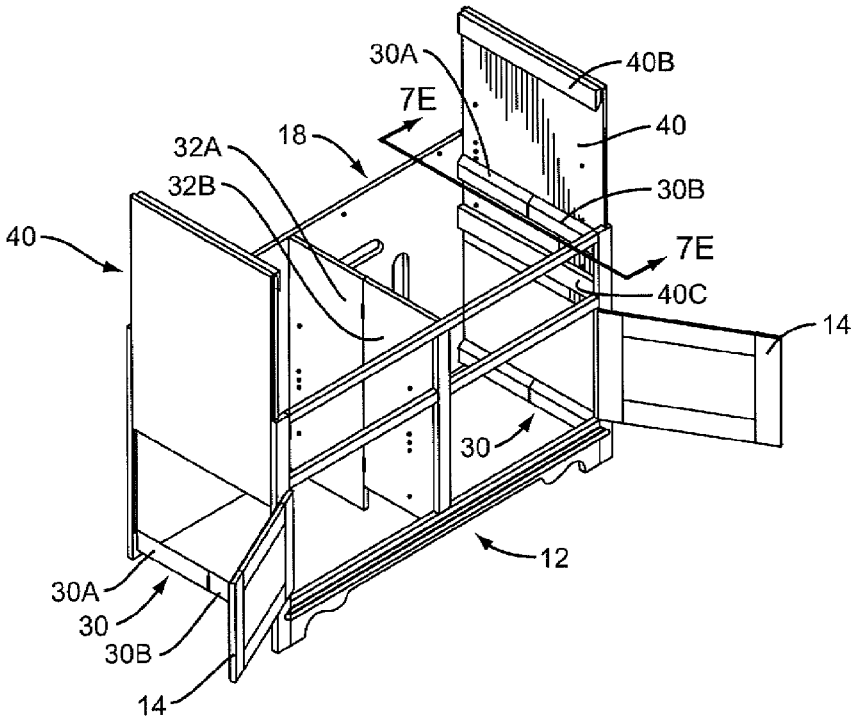
FIG. 5 is a perspective view similar to FIG. 4 and showing the further insertion of the side panels into the folding unit.

Furniture kit 10 includes a folding unit which is shown in FIGS. 2 and 3. The folding unit as shown in FIG. 2 assumes a retracted or collapsed position. In FIG. 3 the folding unit assumes an intermediate position between the retracted and extended position. In FIGS. 4 and 5 the folding unit is shown in the extended position.

Describing the folding unit, it is seen from the drawings that the same includes a front member indicated generally by the numeral 12 and a rear member indicated generally by the numeral 18. Front member 12 forms at least a part of the front of the furniture piece while rear member 18 forms at least a part of the back of the furniture piece. It is appreciated that the front member 12 can assume various designs and have various utility depending on the type of furniture piece that the furniture kit is designed to provide. In this exemplary embodiment, the front member 12 includes a pair of pre-hung doors 14. Doors 14 are hinged to the front member 12. There is provided a magnetic latching device that maintains the doors 14 in a closed position within the front member 12. Kit 10 includes a pair of knobs or handles 68 (see FIG. 1) which can be secured to the doors 14 during the assembly process. In the case of the particular embodiment shown herein, above the doors 14 the front member 12 there is provided with a pair of upper openings 16. Rear member 18 includes a series of ventilation openings 20. As will be discussed subsequently herein, the furniture kit is provided with a pair of side panels, indicated generally by the numeral 40, which are attachable between the front and back members 12 and 18. This attachment is provided through a tongue and groove arrangement. Accordingly, the front member 12 includes a pair of grooves 12A and the rear member 18 includes a pair of grooves 18A for receiving the side panels 40. It is appreciated that the tongue and groove arrangement can be reversed and in such a case instead of the grooves 12A and 18A being provided in the front and back members 12 and 18, there could be tongues provided in which case the side panels would be provided with accepting grooves.

As discussed above, the front and back members 12 are movable with respect to each other and can move between a retracted position and an extended position. To accommodate this function, the folding unit is provided with a series of connectors, with each connector being generally indicated by the numeral 30. Connectors 30 are interconnected between the front member 12 and the back member 18. In the particular embodiment shown herein, there is an upper and lower connector 30 disposed on each side of the folding unit. Note in FIG. 3 where there is an upper connector 30 and a lower connector 30 on each end of the folding unit. These connectors 30 are foldable and are extendable and can move from a retracted or folding position to an extended or straight position. In FIG. 2 the connectors 30 are folded, and hence retraced. In FIGS. 4 and 5 the connectors 30 are extended, and in that position extend in a generally straight line.

In the exemplary embodiment disclosed, each connector 30 is in the form of a folding arm. The folding arm includes two sections, 30A and 30B. These sections are pivotally connected at opposite ends by a hinge to the front and back members 12 and 18. In particular, the folding arms comprised of sections 30A and 30B are hinged at opposite end portions by end hinges 30D. There is also provided an intermediate hinge or pivot 30C that interconnects the two sections 30A and 30B together. Thus, it is appreciated that the folding arms can be folded to a retracted or collapsed position where the two sections 30A and 30B extend in side-by-side relationship. Further, the arms can be extended to where the sections 30A and 30B extend in a generally straight line.

Note that the upper portions of the folding arms or sections 30A and 30B of each connector assumes a beveled or wedge shape. As will be appreciated from subsequent portions of the disclosure, this beveled or wedge shape enables the side panels 40 to engage and lock the folding arms in the extended position shown in FIGS. 4 and 5.

A center panel is interconnected between the front and back members 12 and 18. This center panel includes two pivotally connected panels 32A and 32B. Panels 32A and 32B are hinged at opposite ends to the front and back members 12 and 18. Further, one or more hinge or pivot assemblies interconnects the panels 32A and 32B. This enables the panels 32A and 32B to move from a retracted position to an extended position. In FIG. 2 the panels 32A and 32B are shown in the retracted position and in FIGS. 4 and 5 the panels are shown in the extended position. As will be appreciated from subsequent portions of the disclosure, the panels 32A and 32B, when extended, generally divide the folding unit into halves and the panels 32A and 32B serve to support shelves, drawers, or the like.

Figure 6:
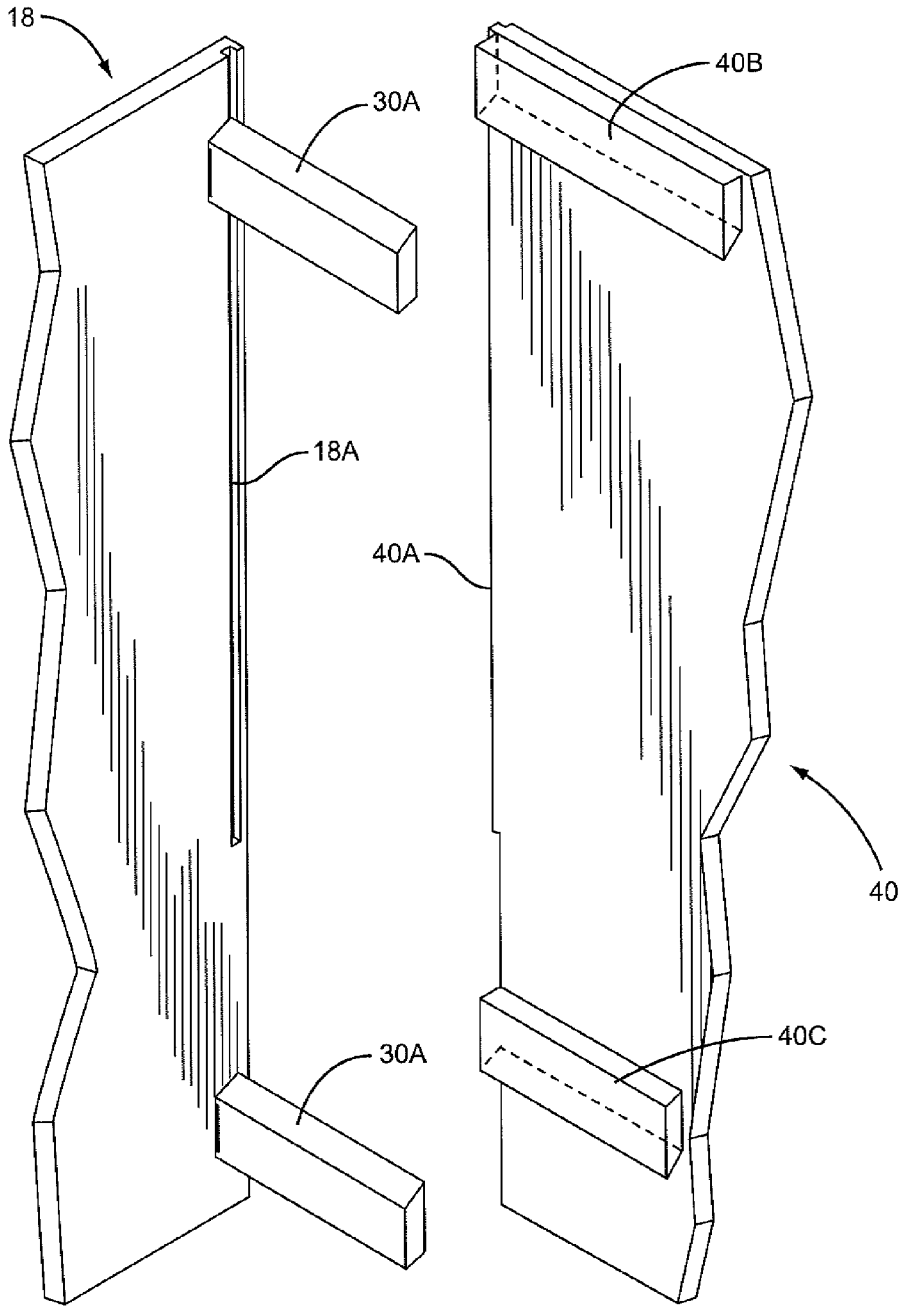
FIG. 6 is a fragmentary perspective view showing the construction of a side panel and a portion of the folding unit.
Figure 7A:
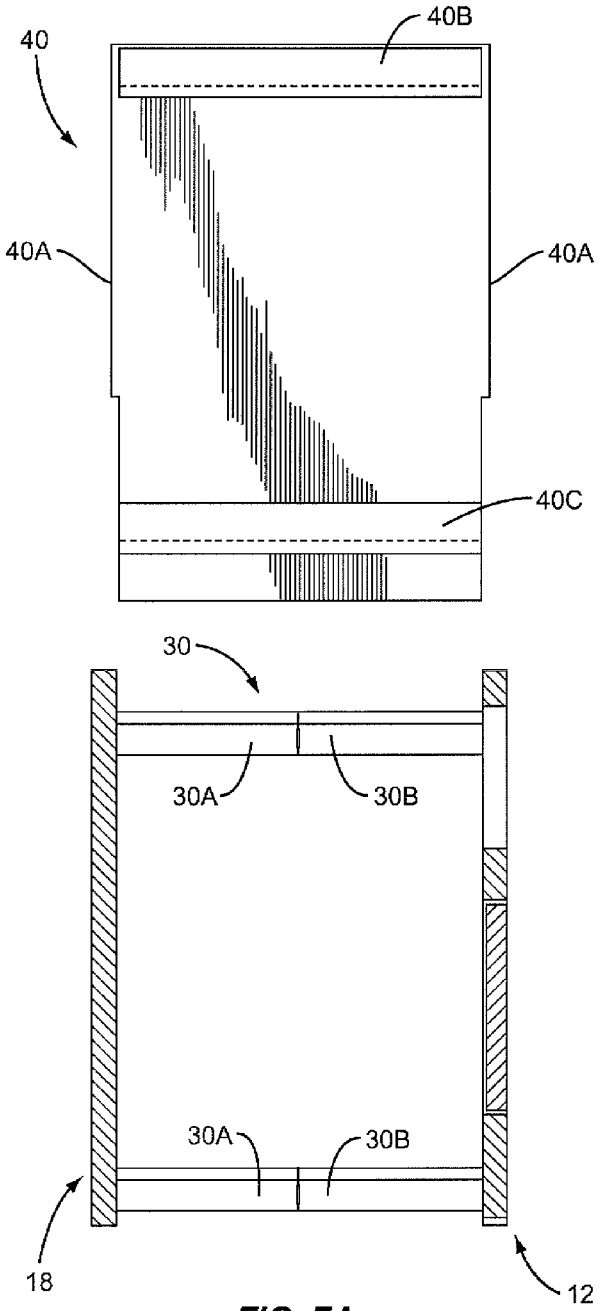
FIGS. 7A-7H are a sequence of views illustrating how the side panel is inserted into the folding unit.
Figure 7B:
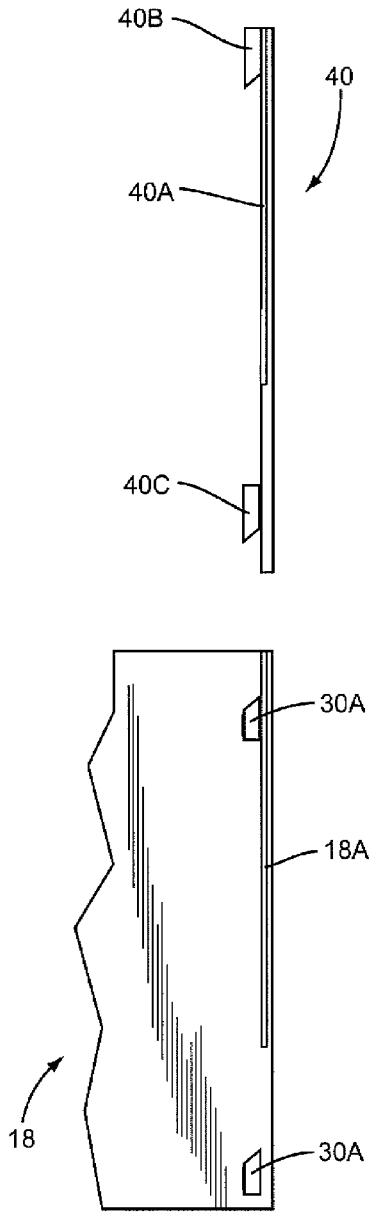
Figure 7C:
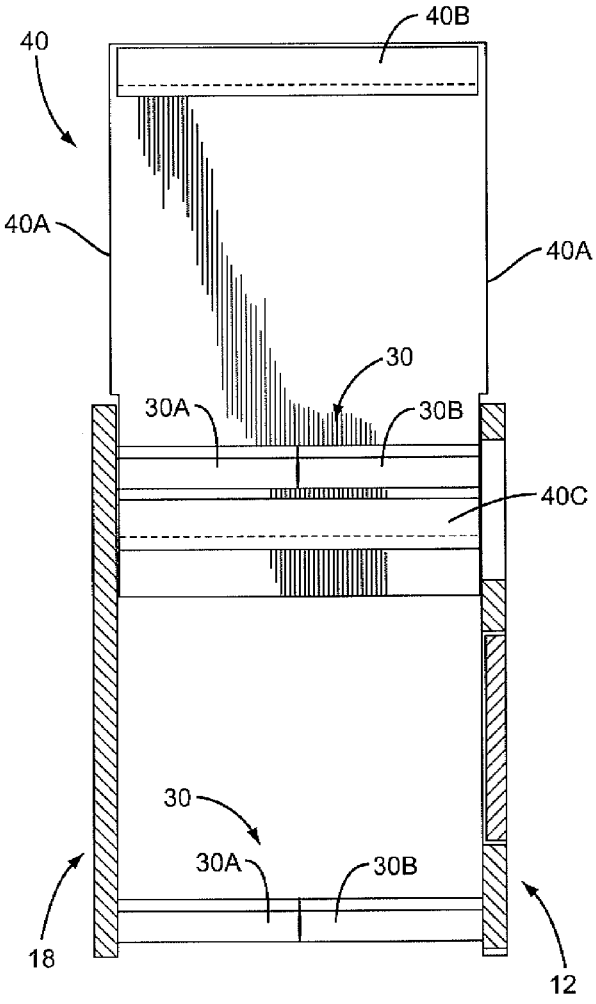
Figure 7D:
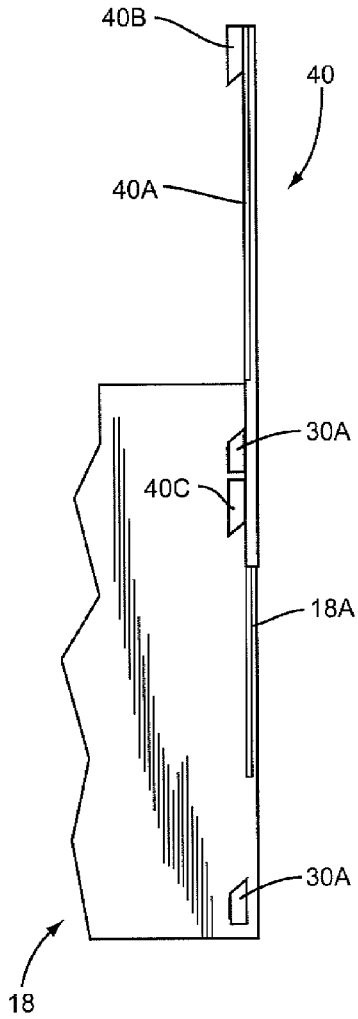
Figure 7E:
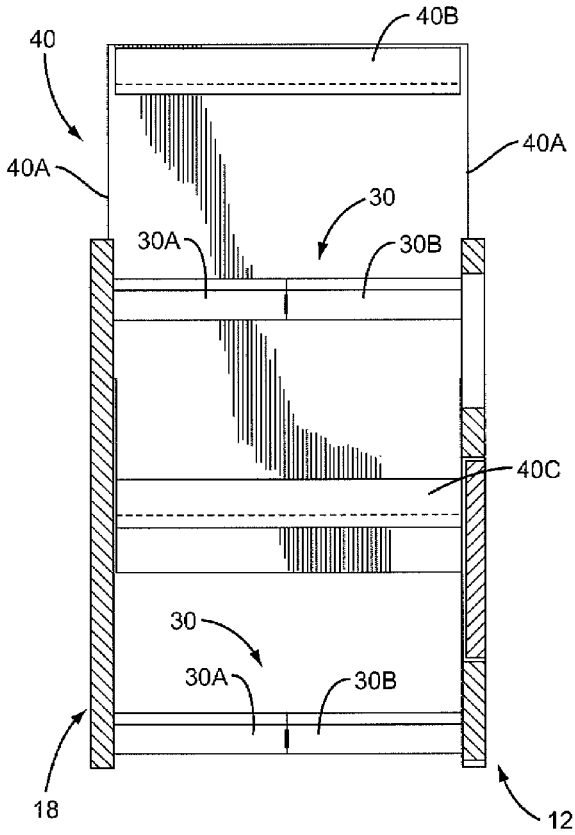
Figure 7F:
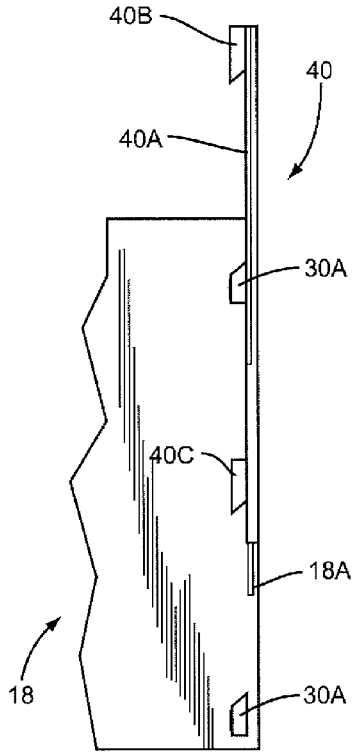
Figure 7G:
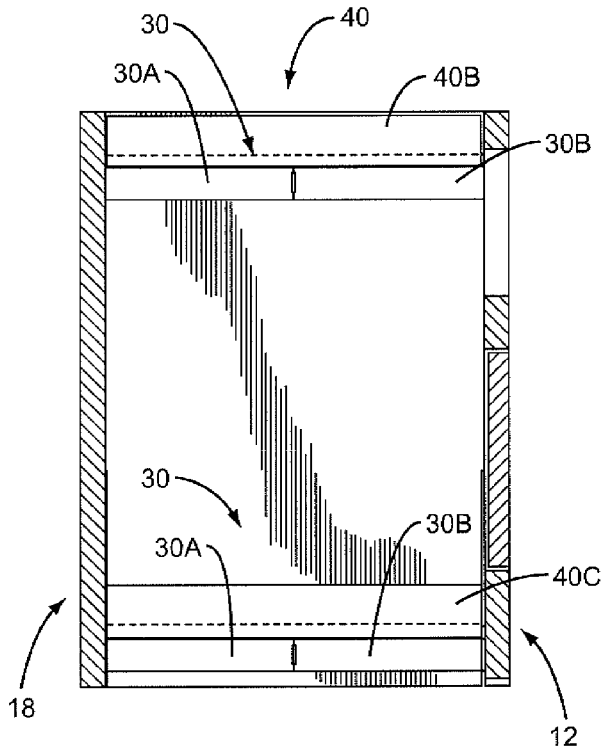
Figure 7H:
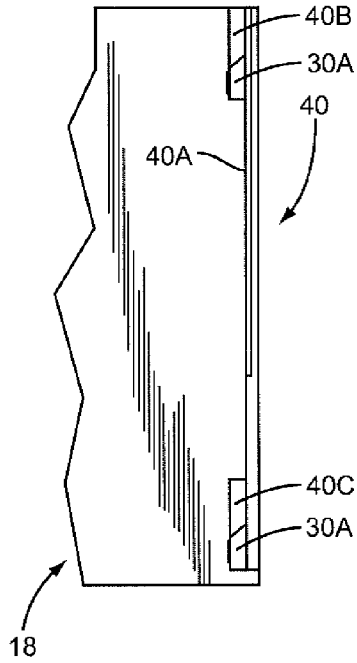
Figure 8:
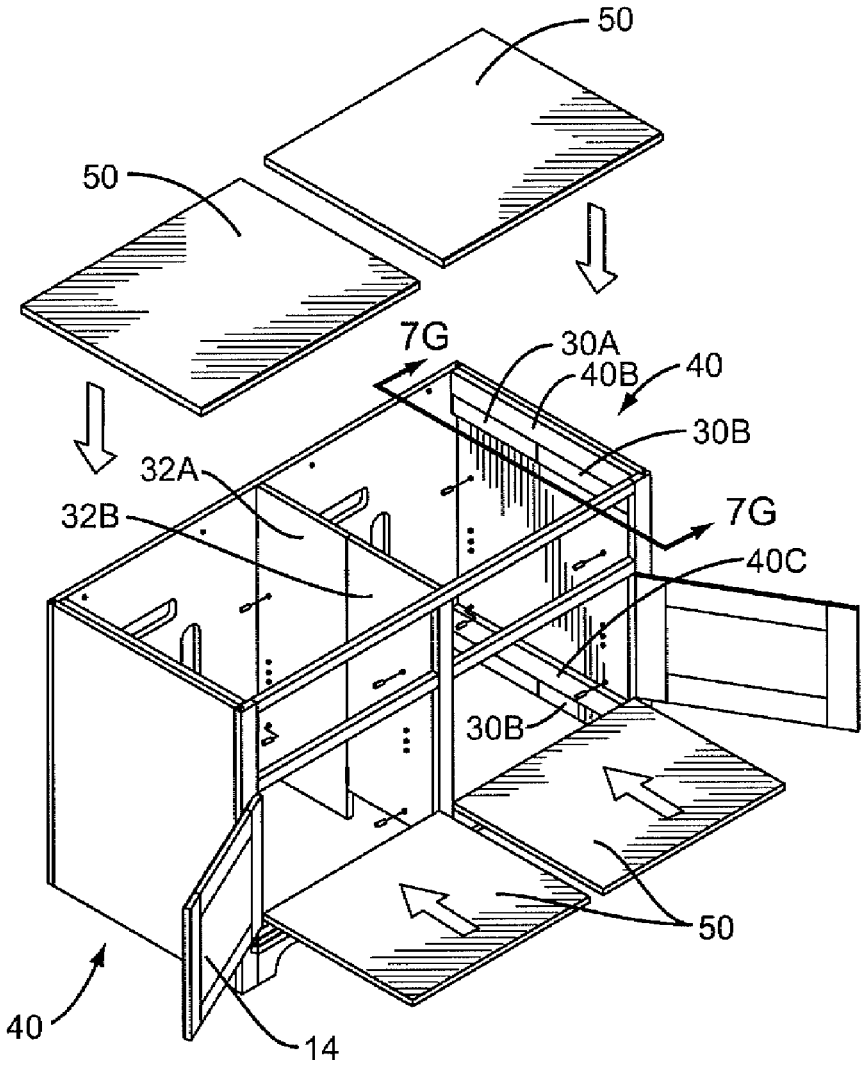
FIG. 8 is a perspective view showing the bottom panels and a pair of shelves prior to being inserted and placed in the folding unit.
Figure 9:
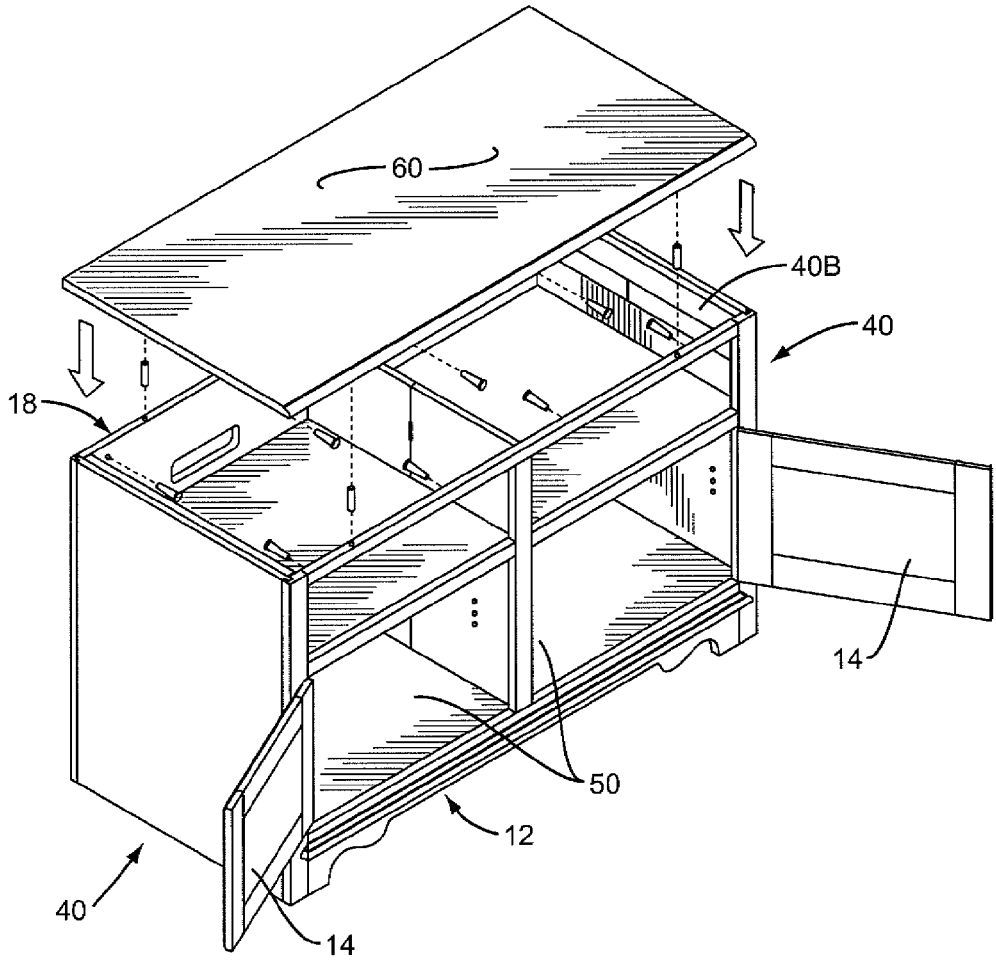
FIG. 9 is a perspective view showing how the top of the furniture kit is placed onto the folding unit.

As briefly discussed above, the side panels 40 are designed to form the sides or ends of the furniture unit and are connectable generally between the front and back members 12 and 18. Before discussing how the side panels 40 are actually connected, it will be beneficial to briefly discuss the structure of the side panel. In the case of this embodiment, each side panel includes a tongue 48 that projects from opposite edges of the panel. Tongue 48 does not extend the complete height of the panel. Rather, the tongue 48 is notched out at the bottom. This is particularly illustrated in FIGS. 6, 7A, and 7C. As will be discussed later, this notched out portion of the tongue enables the side panel 40 to be inserted within the grooves 12A and 18A of the front and back members 12 and 18.

Further, the side panels 40 are designed to interlock with the connectors 30 that extend between the front and back members 12 and 18. More particularly, when the connectors 30 which are made up of sections 30A and 30B are extended, the side panel 40 is designed to engage and interlock with the connectors. Accordingly, each side panel 40 is provided with an upper locking member 40B. See, FIGS. 6 and 7A-7H. Note that the undersurface of the upper locking member 40B is beveled or wedge-shaped. This is to enable the upper locking member 40B to seat on the upper beveled surfaces of the connector sections 30A and 30B. That is, when the side panel 40 is appropriately in place, the upper locking member 40B will extend over and interlock with the upper beveled surface of the connector 30. Because there is also a lower connector 30, each side panel 40 is provided with a lower locking member 40C. The lower locking member 40C is similar to the upper locking member 40B inasmuch as it includes a lower surface that assumes a beveled or wedge shape. This lower surface of the locking member 40C is designed to overlap and interlock with the lower connector 30.

FIGS. 7A-7H describe the method or procedure for inserting each side panel 40. As discussed above, the side panel 40 includes opposed tongues 40A that are designed to fit into grooves 12A and 18A. However, because the connectors 30 and their respective sections 30A and 30B are disposed close to the grooves 12A and 18B, there exists a potential problem in making sure that the lower locking member 40C clears the upper connector 30 when the side panel 40 is inserted into the grooves 12A and 18A. This potential problem is solved by providing the lower cutout of the tongue 40A. This enables the lower portion of each side panel 40 to be inserted between the front and back members 12 without the tongues 40A interfering. Note in FIG. 7C where the side panel 40 has been inserted between front member 12 and back member 18, but where the tongues 40A have not yet been inserted into the grooves 12A and 18A. Also, in this position, it is seen that the lower locking member 40C is below the upper connector 30. From this point, the side panel 40 can be pushed further downwardly to where the tongues 40A enter the notches or grooves 12A and 18A. Then the process can be continued as shown in 7E-7H. Note that when the side panel 40 is completely down, that the upper locking member 40B will overlie and interlock with the upper connector 30 while the lower locking member 40C will overlie and interlock with the lower connector 30. See, FIGS. 7G and 7H. In this position all four connectors 30 are securely locked by the respective locking members 40B and 40C of the side panels 40. This imparts substantial strength and rigidity to the furniture piece.

Figure 10A:
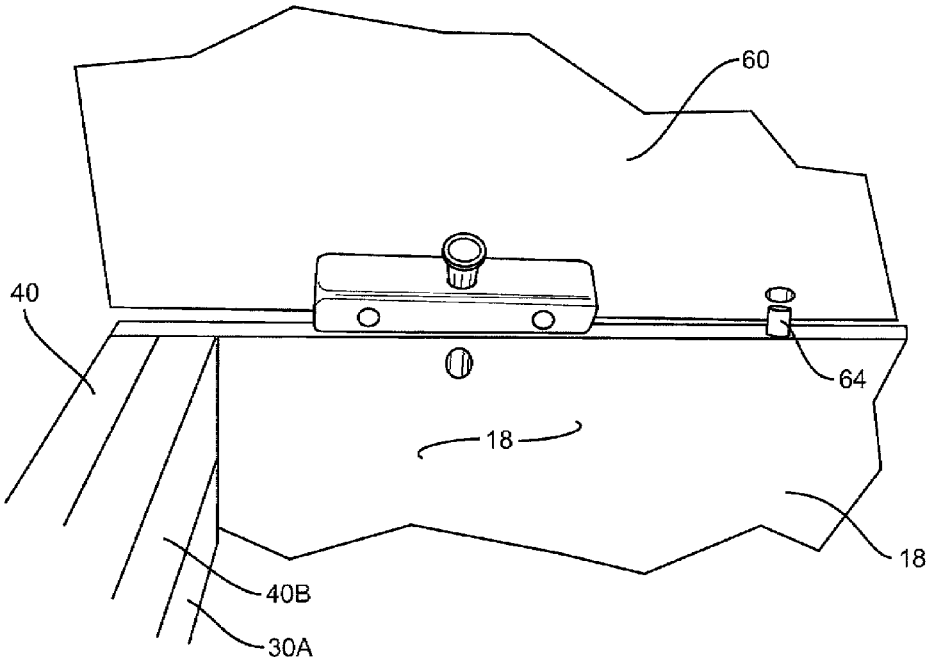
FIG. 10A is a fragmentary perspective view showing the top and the bracket for attaching the top to the folding unit.
Figure 10B:
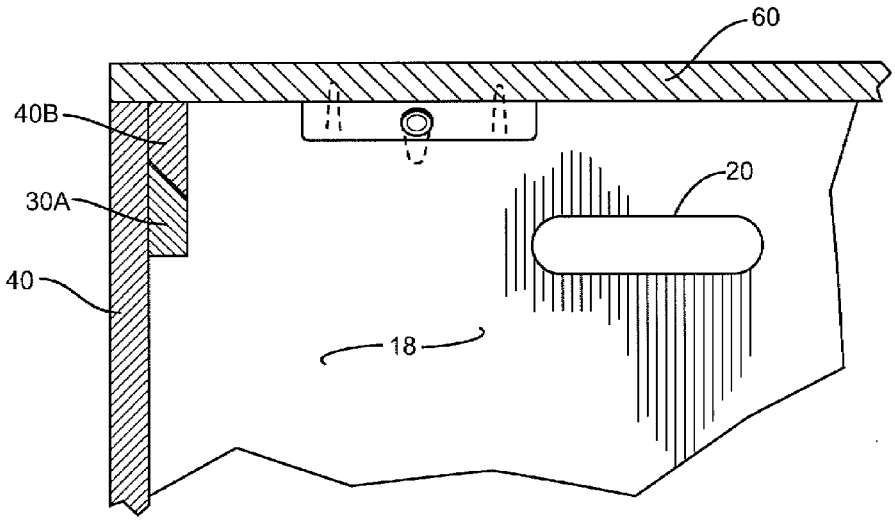
FIG. 10B is a fragmentary view showing how the top is secured to the folding unit.

In the exemplary embodiment shown herein, the furniture piece includes a series of shelves shown in FIG. 1 with each shelf being indicated by the numeral 50. It should be appreciated that the furniture kit could include drawers in lieu of shelves, or a combination of drawers and shelves. If drawers are utilized, the drawers can be constructed such that they also fold into a collapsible configuration. In any event, in the embodiment illustrated herein there is provided a series of six shelves. Two of the shelves will constitute the bottom of the furniture piece. The bottom panels or bottom shelves may require relatively small square corner cutouts in order for the bottom panels to fit around other structures contained in the folding unit. In this case, the bottom panels and upper shelves provide a bottom for the furniture piece, as well as four separate shelves. See FIG. 10. The furniture kit 10 is provided with shelf pins 52 for supporting the respective shelves and bottom panels 50. See FIG. 1. Note that the inside surface of the side panels 40 are provided with an array of openings for receiving the shelf pins 52 at various heights and locations thereon. Likewise, the center panel comprised of sections 32A and 32B include matching openings for receiving shelf pins 52.

The furniture kit 10 also includes a top 60. The top 60 is packaged as a separate component and is secured to the folding unit during assembly. Top 60 includes a series of brackets 62 that assist in securing the top 60 to the front and back members 12 and 18. The brackets 62 are secured to the underside of the top 60 along opposed front and rear edges of the top. When the top is properly placed on the furniture piece or folding unit, the brackets 62 will lie inwardly of the front and back members 12 and 18 but adjacent thereto. See FIGS. 10A and 10B. To properly align the top 60, there is provided a series of dowels 64. See FIG. 1. Dowels 64 are inserted into openings formed in the upper edge of the front and back members 12 and 18. There is also provided matching openings in the underside of the top 60. Thus, once the dowels are inserted into the top edge of the front and back members 12 and 18, the top 60 can be properly placed by simply inserting the dowel openings in the underside of the top 60 onto the dowels.

Each bracket 62 includes a central opening for receiving a fastener 66. See FIG. 1 and the fastener 66 shown therein. In one embodiment each fastener 66 includes a deformable oversize section. Each fastener is first inserted into the opening of the bracket 62 and driven therethrough with a hammer or other implement such that the fastener extends through the bracket and into adjacent pre-drilled openings aligned with the opening in the bracket. As the fastener is driven through the bracket and into the adjacent opening in the front member 12 or back member 18, the large section or portion of the fastener will deform. This securely lodges the fastener in place and securely attaches the top 60 to the folding unit. The intent in this design is to secure the fasteners 66 such that they are not normally removable. It should be appreciated however, that the fasteners 66 can be designed such that they can be easily removed.

Finally, the door handles 68 can be secured to the pre-hung doors 14.

From the foregoing discussion it is appreciated that the present invention presents a furniture kit that can be packaged in a very compact package for shipment and which will substantially reduce cost for shipping furniture pieces. The present design will reduce volume requirements three to four times compared to volume requirements for conventional, fully assembled furniture units. The furniture kit 10 is also designed to yield an appearance that is unlike most ready-to-assemble furniture units. There are no camlocks or other fasteners that are visible. Furthermore, there are no special tools required to assemble the furniture unit. The design is such that assembling the kit is largely intuitive. In the end what is produced is a quality furniture product where the shipping and handling costs are substantially reduced, and wherein the furniture product does not have a conventional "ready-to-assemble" look.

The present invention may, of course, be carried out in other ways than those specifically set forth herein without departing from essential characteristics of the invention. The present embodiments are to be considered in all respects as illustrative and not restrictive, and all changes coming within the meaning and equivalency range of the appended claims are intended to be embraced therein.

What is claimed is:

1. A furniture kit that is configured to be transformed into a furniture piece having a front and a back, the furniture kit comprising:

a. a front member that forms at least a portion of the front of the furniture piece;

b. a back member that forms at least a portion of the rear of the furniture piece;

c. one or more connectors interconnected between the front and back members of the furniture piece;

d. the one or more connectors being movable between a retracted position and an extended position;

e. wherein when the one or more connectors assume the retracted position, the front and back members assume a retracted position and lie relatively close to each other, and wherein when the one or more connectors assume the extended position the front and back members assume an extended position and lie relatively far apart; and f. a pair of side panels with each side panel being connected between able to the front and back members when the front and back members assume the extended position, and wherein at least one side panel is connected to at least one connector when the front and back members assume the extended position.

2. The furniture kit of claim 1 wherein the side panels are connectable to the front and back members by a tongue and groove arrangement.

3. The furniture kit of claim 2 wherein the front and back members include aligned pairs of grooves formed on inner surfaces of the front and back members; and wherein each side panel includes opposed tongues configured to be inserted into the grooves formed on the inner surfaces of the front and back members.

4. The furniture kit of claim 2 wherein the one or more connectors includes one or more arms interconnectable between the front and back members; each arm being movably connected at opposite end portions to the front and back members, and wherein each arm includes two sections pivotally connected together.

5. The furniture kit of claim 4 wherein the one or more members comprise a pair of the arms and wherein the pair of arms is laterally spaced.

6. The furniture kit of claim 5 wherein the one or more connectors include a panel disposed between the pair of arms and wherein the panel is movably connected at opposite end portions to the front and back members and wherein the panel includes two sections that are pivotally connected together.

7. The furniture kit of claim 1 further including a top having a top surface and a bottom surface, and a series of spaced apart attaching brackets disposed along edge portions of the bottom surface of the top for enabling the top to be secured to the front and back members.

8. The furniture kit of claim 7 further including a series of fasteners for extending through the brackets into portions of the front and back members for securing the top to the front and back members.

9. The furniture kit of claim 1 wherein when at least one of the panels is connected to the front and back members to at least one connector, the at least one panel engages the connector and locks the connector in the extended position.

10. The furniture kit of claim 1 wherein at least one side panel includes a locking member for engaging one connector and locking the one connector in the extended position.

11. The furniture kit of claim 10 wherein the locking member includes a beveled shaped surface that engages and interlocks with a beveled shaped surface that forms a part of the connector.

12. The furniture kit of claim 4 wherein there is provided four arms interconnected between the front and back members, and wherein the four arms include a two sets pair of upper and lower arms.

13. The furniture kit of claim 1 wherein the one or more connectors include two connectors with each connector disposed adjacent one side panel when the side panel is connected to the furniture unit; and each side panel including a locking member that engages an adjacent connector and interlocks the connector in the extended position.

14. The furniture kit of claim 13 including an intermediate panel disposed between the two connectors and connected between the front and back members, and wherein the intermediate panel is movable from a retracted position to an extended position.

15. The furniture kit of claim 13 wherein the furniture kit includes a tongue and groove arrangement for enabling the side panels to be connected to the front and back members.

16. The furniture kit of claim 1 including opposing grooves or tongues in the front and back members and tongues or grooves along opposite edges of each side panel such that the side panels can be connected to the front and back members through a tongue and groove arrangement; and wherein at least one side panel includes two spaced apart locking members that engage at least two connectors; and wherein the tongue and groove arrangement does not extend the full height of the front and back members nor the full height of the side panel having the two locking members so as to facilitate connecting the side panels to the front and back members through the tongue and groove arrangement such that both locking members can engage and interlock with at least two connectors.

17. A method of manufacturing a furniture kit that is designed to form a piece of furniture, the method comprising:

a. providing a front member that forms a portion of the front of the piece of furniture;
b. providing a back member that forms a portion of the back of the piece of furniture;
c. interconnecting one or more movable and extendable connectors between the front and back members and movably connecting the one or more extendable connectors to the front and rear members such that the one or more extendable connectors can move between a retracted position and an extended position;
d. wherein when the one or more extendable connectors assume the retracted position, the front and back members are disposed relatively close to each other, and wherein when the one or more extendable members assume the extended position, the front and back members are extended and are spaced relatively far apart;
e. providing a pair of side panels with each side panel being connectable to the front and rear members of the piece of furniture; and
f. interlocking at least one of the side panels with at least one of the connectors when the first and back member assumes the extended position.

18. The method of claim 17 wherein the one or more extendable connectors include a pair of arms interconnected between the front and back members; each arm movably connected at opposite end portions to the front and back members and further including an intermediate pivot that divides the arm into at least two sections that can move with respect to each other.

19. The method of claim 17 including providing opposing grooves or tongues in the front and back members and providing tongues or grooves along opposite edges of each side panel such that the side panels can be connected to the front and back members through a tongue and groove arrangement.

20. The method of claim 17 including providing a top having a top surface and a bottom surface and securing a plurality of brackets around edge portions of the top along the bottom side, wherein the brackets enable the top to be secured to the front and back members.

21. The method of claim 17 wherein the one or more extendable connectors comprises a pair of laterally spaced arms with each arm being pivotally connected about opposite end portions to the front and back members, and wherein each arm includes a pivot that divides the arm into two sections that can move with respect to each other; and wherein the kit includes a folding panel disposed between the two arms with the panel being pivotally connected about opposite end portions to the front and back members, and including a pivot connection that divides the folding panel into two sections that can move with respect to each other such that when the front and back members of the furniture piece are positioned in the extended position, the arms and folding panel move such that when the front and back members assume the extended position, the arms and folding panel assume a generally straight configuration.

* * * * *